US006997246B2

(12) United States Patent
Visser

(10) Patent No.: US 6,997,246 B2
(45) Date of Patent: Feb. 14, 2006

(54) LAMINAR FLOW OPTIONAL LIQUID COOLER

(75) Inventor: Roy Alan Visser, Greentown, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/887,993

(22) Filed: Jun. 25, 2001

(65) Prior Publication Data

US 2002/0195226 A1 Dec. 26, 2002

(51) Int. Cl.
*F28F 13/12* (2006.01)

(52) U.S. Cl. ..... 165/109.1; 165/177

(58) Field of Classification Search ..... 165/41, 165/109.1, 168, 47, 177; 123/198 E
See application file for complete search history.

(56) References Cited

U.S. PATENT DOCUMENTS

| | | | | |
|---|---|---|---|---|
| 2,617,273 A | * | 11/1952 | Findlay | |
| 3,837,396 A | * | 9/1974 | Newton | |
| 4,024,939 A | | 5/1977 | Grieshop et al. | 193/5 |
| 4,798,241 A | * | 1/1989 | Jarrett et al. | 165/109.1 |
| 4,924,838 A | | 5/1990 | McCandless | |
| 6,119,769 A | * | 9/2000 | Yu et al. | 165/109.1 |
| 6,321,832 B1 | | 11/2001 | Le | 165/140 |
| 6,736,195 B1 | * | 5/2004 | Busch et al. | 165/109.1 |

FOREIGN PATENT DOCUMENTS

| | | | | |
|---|---|---|---|---|
| DE | 40 28 437 A1 | * | 3/1992 | 165/109.1 |
| DE | 200 20 347 U1 | | 2/2001 | |
| GB | 1 146 162 A | | 3/1969 | |
| GB | 1 258-061 A | | 12/1971 | |
| GB | 2044430 A | * | 10/1980 | 165/109.1 |

* cited by examiner

*Primary Examiner*—Ljiljana Ciric
(74) *Attorney, Agent, or Firm*—Stefan V. Chmielewski

(57) ABSTRACT

A method and an apparatus for increasing the convective heat transfer capabilities of a liquid cooler coupled to various system and vehicle components. The apparatus includes a structure placed within a hollow tubing of the liquid cooler to distort the laminar flow of fluid within a center portion of the hollow tubing, which decreases the temperature rise of the fluid along an outer wall of the hollow tubing associated with laminar flow. In preferred embodiments, the structure has an elongated baffle wire or an extruded elongated ridge member. The structure allows the outer surface of the tubing to have increased cooling at a particular liquid flow rate. As a result, there is an increase in heat transfer capability to a coupled system or vehicle component.

4 Claims, 3 Drawing Sheets

LAMINAR FLOW OPTIONAL LIQUID COOLER

TECHNICAL FIELD

The present invention relates generally to liquid coolers and more specifically to laminar flow optional liquid coolers.

BACKGROUND

Liquid coolers are used to provide accessory liquid cooling to a wide variety of vehicle and system components. Essentially, liquid coolers consist of fluid tubes coupled to a vehicle or system component. The outer surfaces of the fluid tubes provide a surface to remove heat from the vehicle or system component.

In general, liquid flowing through the tubing experiences laminar flow, turbulent flow, or a combination of laminar and turbulent flow. In the context of liquid coolers, laminar flow is fluid flow in which all fluid motion is in the direction of the axis of the tubing, while turbulent flow is fluid flow in which the fluid is tumbling or mixing within the tube.

Consider laminar flow, for example, in a horizontally oriented simple plain tube having a one-half inch diameter and one meter long having diesel flow entering the tube at a bulk flow rate of 0.5 liters per minute and wherein 50 watts is applied evenly to the tubing wall. Where the bulk inlet diesel fuel temperature is fifty degrees Celsius, the bulk outlet diesel fuel temperature will be 53 degrees Celsius. The temperature along the tubing wall, and the diesel fuel very close to the tubing wall, is 76 degrees, or 24.5 degrees hotter than the average fluid temperature. This demonstrates that the temperature rise within the fluid from the bulk of the fluid to the inside wall of the tubing dominates the total temperature rise. As the amount of heat that a liquid cooler is able to remove is proportional to the temperature difference between the the tubing wall surface and fluid and to the surface area of the tubing available to the fluid, liquid coolers in the present art incorporate expensive u-bends in their designs to increase the surface area and overcome the low convection performance ability of the tubing.

It is therefore highly desirable to limit the temperature rise between the inside wall of a tubing and a liquid flowing through the tubing at a constant flow rate. This would increase the thermal effectiveness of the liquid cooler for cooling an associated component. This would also allow liquid coolers to be formed with decreased sizes while limiting or eliminating expensive u-bends that are normally necessary to provide adequate cooling to an associated component.

SUMMARY OF THE INVENTION

It is thus an object of the present invention to provide a method for limiting the temperature rise between the inside wall of the tubing of a liquid cooler tubing and the liquid flowing through it in a laminar flow manner.

The above object is accomplished by introducing a structure to the inside of the tubing that acts to distort the laminar flow, thereby reducing the heat rise that occurs at the surface of the inner wall due to laminar flow. Therefore, more heat is capable of being conducted from an associated structure coupled to the cooler tubing surface, thereby providing increased thermal effectiveness. In addition, costs for manufacture of the liquid coolers are reduced because smaller liquid coolers may be utilized and because these new liquid cooler are produced using simpler manufacturing techniques.

In one preferred embodiment of the present invention, a wire baffle having at least two kink regions is introduced to the tubing. The majority of the wire length is contained within the center of the tube and disrupts laminar flow within the center of the tube.

In another preferred embodiment of the present invention, in which an extruded elongated ridge member is formed within a portion of the hollow tubing, surface area within the tubing is increased by an additional 60%, thereby further reducing the thermal increase associated with laminar flow located at the outer tubing by an additional increment.

Other objects and advantages of the present invention will become apparent upon considering the following detailed description and appended claims, and upon reference to the accompanying drawings.

DESCRIPTION OF THE PREFERRED EMBODIMENT(S)

Figure 1:
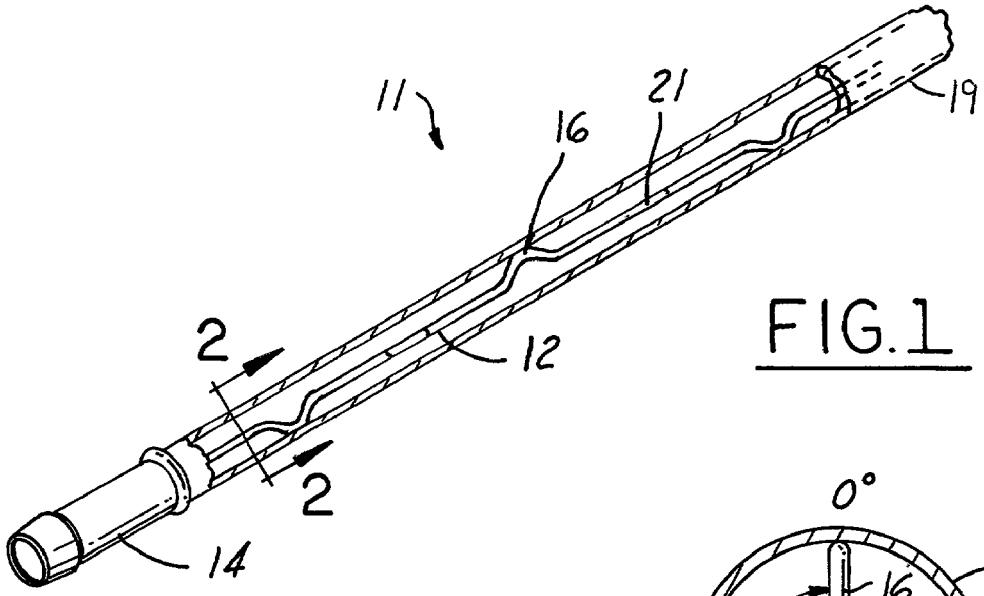
FIG. 1 is a perspective view of a liquid cooler according to one preferred embodiment of the present invention.

Referring now to FIG. 1, a liquid cooler 11 according to one preferred embodiment is depicted as having a wire baffle 12 contained within a tube 14. The wire baffle 12 is formed with a minimum of two spaced kink regions 16 situated along its length 1. For a tube 14 approximately ½ inch in diameter, a wire baffle of approximately 0.023 inch diameter having kink regions 16 approximately every 40 millimeters is preferable, although thicker or thinner wires having kink lengths of different sizes are contemplated. Each kink region 16 has an outer lobe region 17 that abuts an inner circular wall portion 18 of the tube 14. The shape of each kink region is preferably oval-shaped, but other smooth shape such as substantially half-circled are contemplated. The tube 14 also has an outer wall 19.

Figure 2:
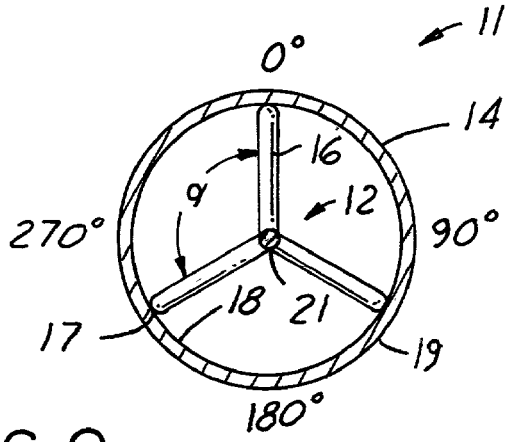
FIG. 2 is a end view of FIG. 1.

FIG. 2 illustrates an end view of FIG. 1 showing the wire baffle 12 within the inner circular wall portion 18 of the tube 14. For illustrative purposes, the inner circular wall portion 18 lists various relative degree positions. For example, the top of the inner circular wall portion 18 is listed at 0 degrees, or twelve o'clock; the right side portion is listed at 90 degrees, or three o'clock; the bottom portion is listed at 180 degrees, or six o'clock; and the left side portion is listed at 270 degrees, or nine o'clock.

As seen in FIG. 2, each subsequent kink region 16 is rotated at an angle α from the outer lobe region 17 of one kink region 16 to the outer lobe region 17 of an adjacent kink region 16. Together, the number of kink regions 16 and the angle α between the adjacent kink regions 16 are set to ensure that the straight wire length 21 is located within the center of the tube 14. Further, this angle α ensures that certain kink regions 16 may be planar or not planar with respect to one another. Preferably, at least one kink region 16 is not planar with another kink region 16.

As best seen in FIG. 2, angle α is preferably set to 120+/−degrees such that each three adjacent kink regions 16 serve to locate the straight wire length 21 of the baffle wire 12 within the center of the tube 14. In FIG. 2, each subsequent kink region 16 is set at 0 degrees, 120 degrees, and 240 degrees respectively. Of course, this angle α may be varied and still ensure that the straight wire length 21 is maintained within the center of the tube. For example, angle α could be 90 degrees such that each four adjacent kink regions 16 serve to locate the straight wire length 21 of the baffle wire 12 within the center of the tube 14. In this scenario, the relative locations of the kink regions 16 would be 0 degrees, 90 degrees, 180 degrees, and 270 degrees respectively.

Further, in alternative embodiments not shown, the relative location between adjacent kink regions 16 may be varied non-regularly from zero degrees to 360 degrees. However, in this scenario, as above, the number of kink regions 16 must ensure that the straight wire length 21 is maintained within the center of the tube 14. Also, the length of each subsequent straight wire length 21 may be the same, shorter, or longer than the previous adjacent straight wire length 21 and still be within the spirit of the present invention.

A principle of fluid dynamics states that the fluid speed at any stationary surface within a tubing is zero. In a tube without a wire baffle, the maximum velocity of fluid through a tube is at the center of the tubing, while fluid flow at the inner tubing wall is approximately zero. A graph of fluid velocity along any cross-section diameter of the tube without the wire baffle would have a parabola shape, like the profile of half of a watermelon.

The placement of the wire baffle 12 within the tube 14 as in FIGS. 1 and 2 provides such a stationary surface and distorts the laminar flow, so that the maximum velocity of fluid flow is no longer located at the center of the tube 14, but is instead located at a point midway between center of the tube 14 and the inside circular wall portion 18 of the tube 14. A graph of velocity plotted along any cross-section diameter of the tube 14 having a wire baffle 12 would result in a parabola with roughly ½ the width of a plot without the wire baffle 12. As the convective heat transfer coefficient h is inversely proportional to the width of the parabola, temperature rise at the inside circular wall portion 18 and outer wall 19 of the tube 14 will decrease dramatically with the introduction of the baffle wire 12.

Liquid coolers 10 are typically coupled with system or vehicle components and are used to remove heat that is built up during the operation of these components, heat that may have a deleterious effect on the operations of the components. The amount of heat that may be drawn from the components is directly related to the heat buildup on the outer wall 19 of the liquid cooler 11. Thus, the cooler the outer wall 19 of the liquid cooler, the more heat that may be drawn away from the component by conductance.

Figure 3:
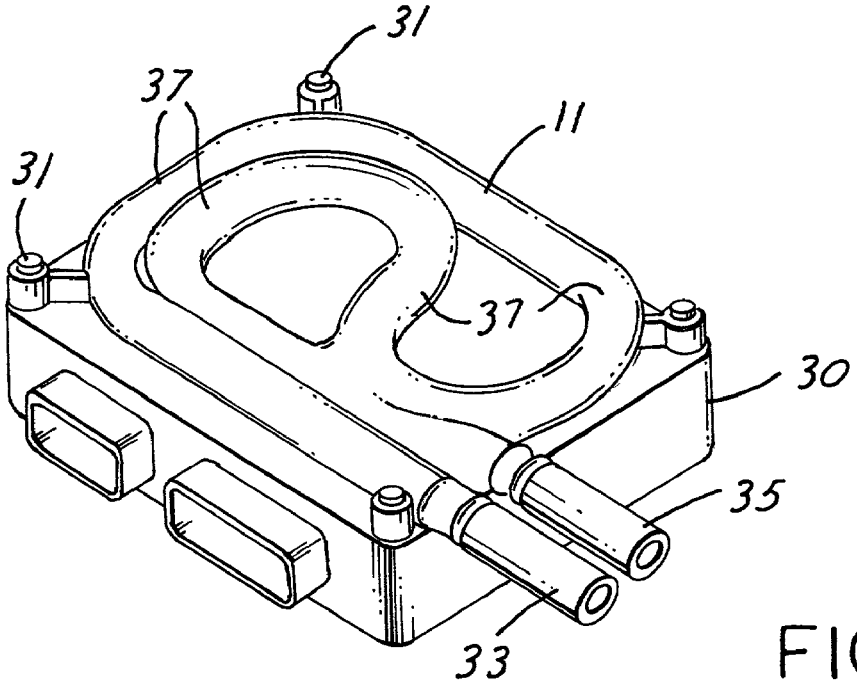
FIG. 3 is a perspective view of the liquid cooler of FIG. 1 mounted to an engine control module.

Referring now to FIG. 3, a liquid cooler 11 similar to FIGS. 1 and 2 is shown coupled to a vehicle component, in this case an engine control module 30. The liquid cooler 11 is preferably attached to the electronic control module 30 with screws 31. Of course, other methods of attachment known in the art are specifically contemplated. For example, the liquid cooler 11 could be installed within an aluminum die casting that is formed by pouring molten aluminum around the liquid cooler 11.

The liquid cooler 11 has an inlet 33 and outlet 35 that attach to ends of a rubber fuel line (not shown) using a metal crimp or some other attachment means well known to attach tubings in the art. In addition, a layer of thermal grease (not shown), thermal adhesive (not shown), or a film interposer (not shown) common to the electronics industry may be placed between the liquid cooler 11 and the electronic control module 30 to increase its thermal effectiveness. In addition, to further increase the thermal effectiveness of the liquid cooler 11, a series of bends 37 may introduced to the liquid cooler 11. The number of bends 37 is a function of the amount of cooling that is necessary for the electronic control module 30.

Figure 4:
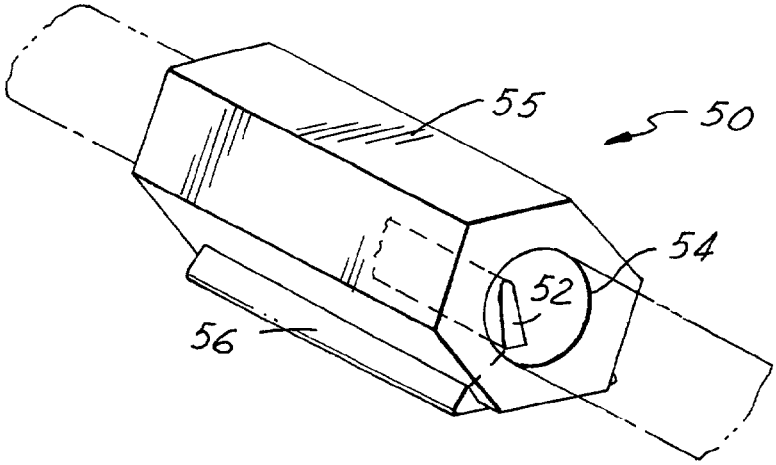
FIG. 4 is a perspective view of a coax-tang extrusion tube assembly according to another preferred embodiment of the present invention.
Figure 5:
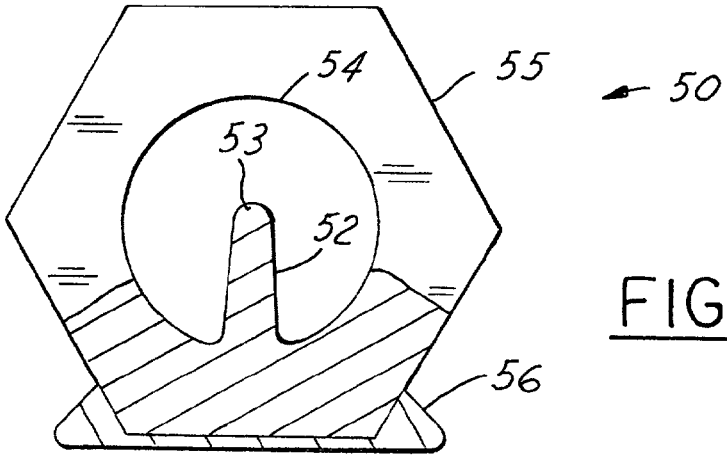
FIG. 5 is an end view of the liquid cooler of FIG. 4.

Referring now to FIGS. 4 and 5, a liquid cooler 50 according to another preferred embodiment is shown having an elongated ridge member 52 extending throughout the length and internal to a tube 54. The middle portion 53 of the elongated ridge member 52 is located near the center of the tube 54 and functions to disrupt the laminar flow in the center of the tube similar to the baffle wire 12 of FIGS. 1–3. The tube 54 is typically fabricated with a hexagonal outer surface 55 for use with a counter torque wrench and may be fitted with female threads 57 for ease of installation. Further, the tube 54 contains a thermal interface plate 56 for enhancing heat transfer capabilities.

Figure 6:
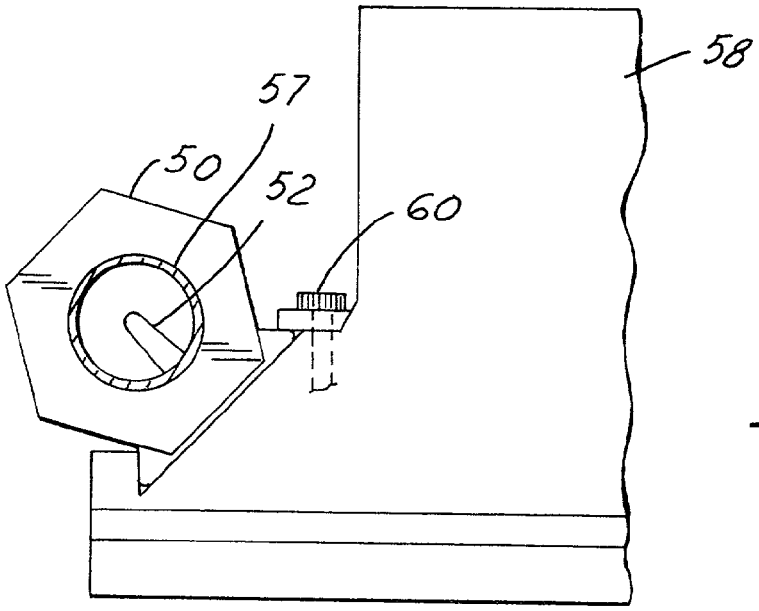
FIG. 6 is a perspective view of the liquid cooler of FIG. 4 mounted to an engine control module.

As best seen in FIG. 6, the thermal interface plate 56 is coupled to a vehicle component such as an electronic control module 58 with a row of screws 60. Of course, the plate 56 may be secured to the electronic control module 58 in a wide variety of other manners well known in the art. In addition, a layer of thermal grease (not shown), thermal adhesive (not shown) or a film interposer (not shown) common to the electronics industry may be placed between the plate 56 and the electronic control module 58 to further enhance heat transfer characteristics.

The liquid cooler 50 having the elongated ridge member 52 is typically an extrusion of aluminum 6063-T6 alloy, but other metals may be used as are known in the art. The liquid cooler 50 has many advantages over typical liquid coolers known in the art. First, as with the wire baffle 12, the middle portion 53 of the elongated ridge member 52 reduces the parabolic width, roughly doubling the convective heat transfer coefficient h, to cool the inner surface 60 of the tube 54. Second, the elongated ridge member 52 increases the surface area inside the tube 54 by roughly 60%, which further increases the thermal effectiveness of the liquid cooler 50. Third, because elongated ridge member 52 is rooted closest to the thermal interface plate 56, additional heat transfer characteristics are realized, as the elongated ridge member 52 helps to directly heat sink the heated surface of a coupled component. It is estimated that increases the thermal effectiveness by another 2%. Combined, it is estimated that the elongated ridge member 52 may reduce thermal resistance for a given length of liquid cooler 50 to less than half of that for a smooth tube.

Figure 7:
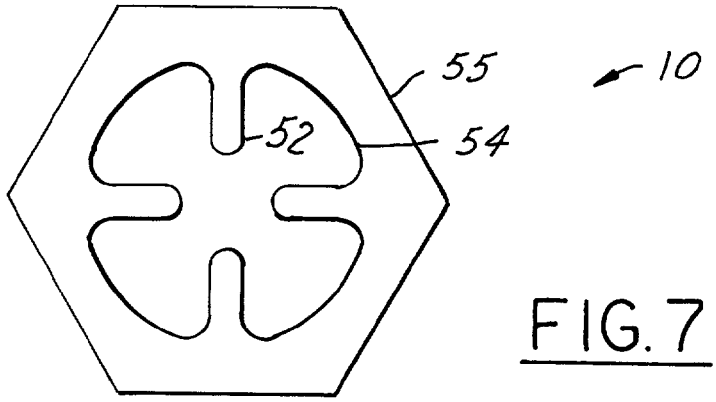
FIG. 7 is an end view of a liquid cooler according to another embodiment of the present invention.
Figure 8:
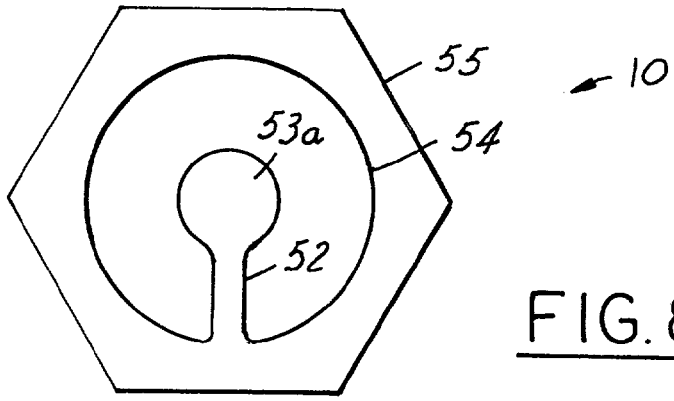
FIG. 8 is an end view of a liquid cooler according to another embodiment of the present invention.
Figure 9:
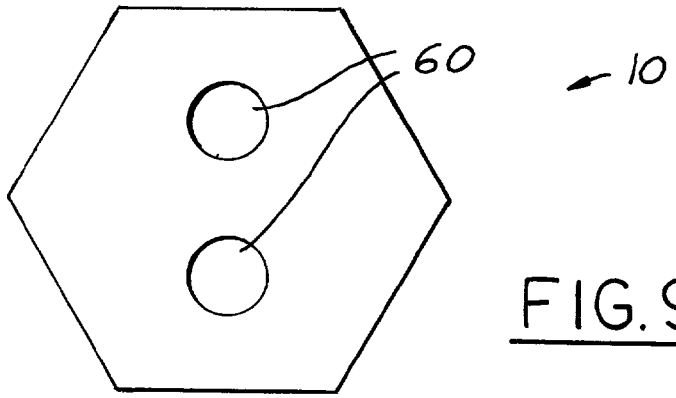
FIG. 9 is an end view of a liquid cooler having a dual-tube design according to another embodiment of the present invention.
Figure 10:
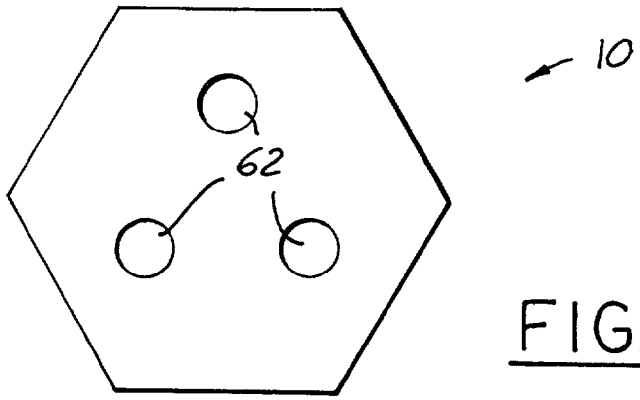
FIG. 10 is an end view of a liquid cooler having a tri-tube design according to another embodiment of the present invention.

While the liquid cooler 50 of FIGS. 4–6 shows a single elongated ridge member 52, it is contemplated that a great number of different designs of elongated ridge members 52 other than what is depicted are possible. For example, as shown in FIG. 7, the number of elongated ridge members 52 may be increased around the outer periphery of the tube 54. Further, as shown in FIG. 8, the shape of the elongated ridge member 52 could be varied by making the middle region 53*a* of the member 52 more circular. Further, a dual-tube 60 or tri-tube 62 concept, shown as FIGS. 9 and 10, could replace the elongated ridge member 52 concept. Design concepts such as in FIGS. 7–10 are representative of other embodiments that would reduce the parabolic width or eliminate the laminar flow through the center of the tube 54. However, the flow through these tubes 54 is undesirably restricted by their shapes and thus are less desired designs.

The liquid cooler 11 of FIGS. 1–3 and liquid cooler 50 of FIGS. 4–6 may be used in a wide variety of applications. For example, the liquid cooler 11, 50 may be used in heavy and/or light-duty diesel controller programs, wherein the liquid cooler 11, 50 is actually a diesel fuel line. The liquid cooler 11, 50 may be a regular gas line, a motor oil line, a water-mix engine coolant line, or any other type of fluid tubing that is contemplated to cool a vehicle or system component as is contemplated within the art.

The present invention offers many improvements over currently available liquid coolers. First, previous designs of liquid coolers required expensive unbending to increase the overall length due to low convective performance ability. The present invention eliminates this expense by increasing the convective performance of the liquid cooler 11, 50 by reducing the parabolic width. Second, previous fin designs commonly used in liquid coolers assumed air-like turbulent flow. However, fuel, especially diesel fuel, experiences mainly laminar flow within a tubing. The present invention works in conjunction with laminar flow, not turbulent flow, which is exhibited in liquid fuel systems. Third, the liquid cooler 11, 50 increases surface area in viscous fuel flow that decreases the laminar flow width, thereby allowing shorter liquid coolers which greatly reduce cost of manufacture and space.

While the invention has been described in terms of preferred embodiments, it will be understood, of course, that the invention is not limited thereto since modifications may be made by those skilled in the art, particularly in light of the foregoing teachings.

What is claimed is:

1. A method for improving the cooling capabilities of a liquid cooler having a hollow tubing having an outer wall and a hollow inner portion, the method comprising the steps of:

providing a laminar flow of a liquid through the hollow tubing; and distorting the laminar flow of the liquid by providing a stationary structure within the hollow inner portion of the tubing so that the maximum velocity of the laminar flow is located substantially midway between a center portion and the outer wall of the hollow tubing, whereby a rise in temperature along an outer surface of the outer wall is minimized.

2. The method of claim 1, wherein providing the stationary structure within the hollow tubing increasing the surface area within the hollow tubing.

3. The method of claim 2, wherein providing the stationary structure comprises the step of providing a baffle wire within the hollow tubing, the baffle wire having a straight wire region interposed between each two adjacent of at least two kink regions, each of the at least two kink regions having a lobe region abutting the inner wall, wherein the lobe regions serve to locate the straight wire region along the center portion, wherein the straight wire region shifts the laminar flow.

4. The method of claim 2, wherein providing the stationary structure comprises the step of introducing an elongated ridge member to a first location on a circular inner wall portion of said hollow tubing, wherein said elongated ridge member has a pair of end regions secured at said first location and a middle portion extending to said center portion, wherein said first location is in closest proximity with a thermal interface portion of said liquid cooler.

* * * * *